US008439761B2

(12) United States Patent
O'Keene et al.

(10) Patent No.: US 8,439,761 B2
(45) Date of Patent: May 14, 2013

(54) GAMING CABINET WITH A GAMING DECK CAPABLE OF BEING SLID AWAY FROM THE DISPLAY AND ROTATED IN EITHER UPWARD OR DOWNWARD DIRECTIONS

(75) Inventors: Dugan S. O'Keene, Forest Park, IL (US); Scott M. Irving, Roselle, IL (US); John J. Beirne, St. Charles, IL (US)

(73) Assignee: Elite Casino Products, Inc., Itasca, IL (US)

( * ) Notice: Subject to any disclaimer, the term of this patent is extended or adjusted under 35 U.S.C. 154(b) by 608 days.

(21) Appl. No.: 12/620,219

(22) Filed: Nov. 17, 2009

(65) Prior Publication Data

US 2010/0124994 A1 May 20, 2010

Related U.S. Application Data

(60) Provisional application No. 61/115,188, filed on Nov. 17, 2008.

(51) Int. Cl.
*A63F 9/24* (2006.01)

(52) U.S. Cl.
USPC ..... 463/46

(58) Field of Classification Search ..... 312/223.1; 361/752; 463/46
See application file for complete search history.

(56) References Cited

U.S. PATENT DOCUMENTS

| | | | | |
|---|---|---|---|---|
| 5,676,231 | A * | 10/1997 | Legras et al. | 194/206 |
| 6,201,532 | B1 * | 3/2001 | Tode et al. | 345/156 |
| 6,201,703 | B1 * | 3/2001 | Yamada et al. | 361/752 |
| 6,474,758 | B1 * | 11/2002 | Hedrick et al. | 312/223.1 |
| 6,572,204 | B1 * | 6/2003 | Hedrick et al. | 312/223.1 |
| 6,702,409 | B2 * | 3/2004 | Hedrick et al. | 312/223.1 |
| 6,997,810 | B2 * | 2/2006 | Cole | 463/46 |
| 7,513,830 | B2 * | 4/2009 | Hajder et al. | 463/46 |
| 7,938,728 | B2 * | 5/2011 | Vetter et al. | 463/46 |
| 7,985,139 | B2 * | 7/2011 | Lind et al. | 463/46 |
| 2004/0018877 | A1 * | 1/2004 | Tastad et al. | 463/46 |
| 2005/0168499 | A1 * | 8/2005 | Williams et al. | 345/905 |
| 2008/0113821 | A1 * | 5/2008 | Beadell et al. | 463/46 |
| 2009/0280911 | A1 * | 11/2009 | Tsao | 463/46 |

* cited by examiner

*Primary Examiner* — Dmitry Suhol
*Assistant Examiner* — Jason Yen
(74) *Attorney, Agent, or Firm* — Richards Patent Law P.C.

(57) ABSTRACT

A gaming cabinet includes a first side panel, a second side panel disposed away from and substantially parallel to the first side panel, and a video display carried between the first and second side panels, wherein the video display is arranged substantially perpendicular to the first and second side panels. The gaming cabinet further includes a translatable gaming deck carried between the first and second side panels, wherein the translatable gaming deck is arranged substantially perpendicular to the first and second side panels and the video display, wherein the translatable gaming deck is configured to be linearly translated away from the video display, and wherein the translatable gaming deck is configured to be rotated to a position substantially parallel to the video display when linearly translated away from the video display.

14 Claims, 7 Drawing Sheets

GAMING CABINET WITH A GAMING DECK CAPABLE OF BEING SLID AWAY FROM THE DISPLAY AND ROTATED IN EITHER UPWARD OR DOWNWARD DIRECTIONS

PRIORITY CLAIM

This patent document claims the priority benefit provided under 35 U.S.C. §119(e) to U.S. provisional patent application Ser. No. 61/115,188, filed on Nov. 17, 2008. The content of this provisional patent application is incorporated herein by reference for all purposes.

BACKGROUND

Gaming apparatuses or machines such as slot machines, video slot machines, video gaming terminals and the like are common fixtures within gambling casinos. Each gaming machine represents both a significant capital investment and a long term source of revenue for the gambling casino. In order to maximize potential revenue, gaming machines are often arranged in tightly spaced banks or groups in an effort to efficiently utilize the gambling casinos' floor space. The configuration or arrangement of the gaming machines is influenced by many factors such as, for example: fire and safety regulations that dictate the crowd and aisle limitations; traffic and access patterns between the different portions or elements within the gambling casino; and accessibility of power, communications and networking access points for connecting and operating the gaming machines.

Another factor that influences or limits the configuration or arrangement of the gaming machines is the physical size of the devices themselves. Ideally gaming machines are placed close enough together to maximize available floor space, but far enough apart to allow a player to comfortably interact with the gaming machine's buttons, controls, or interface. Tight spacing between individual gaming cabinet may allow for increased utilization of floor space while simultaneous making service, maintenance and/or repair more difficult due to the lack of room or space around each gaming cabinet.

These different, and often competing, factors can make it difficult for gambling casino operators to balance, for example, the ease of service, providing players an enjoyable gaming experience, player's comfort against the requisite safety regulations and maximizing the available floor space. It would be desirable to provide a gaming cabinet that could address or alleviate some of these issues.

SUMMARY

The disclosed gaming cabinet provides an ergonomic housing that supports, for example, a large and/or widescreen monitor or liquid crystal display while affording service and maintenance personnel easy access to the components and elements contained therein. The disclosed gaming cabinet includes a slidable table top or playing surface. The slidable table top or playing surface may, in turn, be rotated vertically up or down (relative to the surface upon which the cabinet is supported) to allow access to an interior of the cabinet.

In one embodiment, a gaming cabinet is disclosed. The gaming cabinet includes a first side panel, a second side panel disposed away from and substantially parallel to the first side panel, and a video display carried between the first and second side panels, wherein the video display is arranged substantially perpendicular to the first and second side panels. The gaming cabinet further includes a translatable gaming deck carried between the first and second side panels, wherein the translatable gaming deck is arranged substantially perpendicular to the first and second side panels and the video display, wherein the translatable gaming deck is configured to be linearly translated away from the video display, and wherein the translatable gaming deck is configured to be rotated to a position substantially parallel to the video display when linearly translated away from the video display.

In another embodiment, a gaming unit is disclosed. The gaming unit include a gaming cabinet including a first side panel disposed away from and substantially parallel to a second side panel, and a video display carried by the gaming cabinet, wherein the video display is arranged substantially perpendicular to the first and second side panels. The gaming unit further includes a gaming deck translatable along at least one linear rail mounted to an interior surface of the first and second side panels, wherein the gaming deck is aligned substantially perpendicular to the first and second side panels and the video display, wherein the translatable gaming deck is configured to be linearly translated away from the video display along the at least one linear rail, and wherein the translatable gaming deck is configured to rotate to a vertical position substantially parallel to the video display when linearly translated away from the video display.

In another embodiment, a method of servicing a gaming unit including a gaming cabinet having a first side panel disposed away from and substantially parallel to a second side panel and a video display carried by the gaming cabinet, wherein the video display is arranged substantially perpendicular to the first and second side panels is disclosed. The method includes engaging a gaming deck portion of the gaming unit wherein the gaming deck is aligned substantially perpendicular to the first and second side panels and the video display, translating the gaming deck portion of the gaming unit along at least one linear rail mounted to an interior surface of the first and second side panels wherein the translatable gaming deck is configured to be linearly translated away from the video display along the at least one linear rail.

Other embodiments are disclosed, and each of the embodiments can be used alone or together in combination. Additional features and advantages of the disclosed embodiments are described in, and will be apparent from, the following Detailed Description and the figures.

DETAILED DESCRIPTION

The disclosed gaming cabinet provides an ergonomic housing that supports, for example, a large and/or widescreen monitor or liquid crystal display while affording service and maintenance personnel easy access to the components and elements contained therein. The disclosed gaming cabinet includes a translatable table top or playing surface. The translatable or slidable gaming deck may, in turn, be rotated vertically up or down (relative to the surface upon which the cabinet is supported) to allow access to an interior of the cabinet. As used herein the terms playing surface, gaming deck and/or table top are used synonymously to generally describe the mechanism by which the interior of the gaming cabinet may be accessed for service and maintenance.

Figure 1:
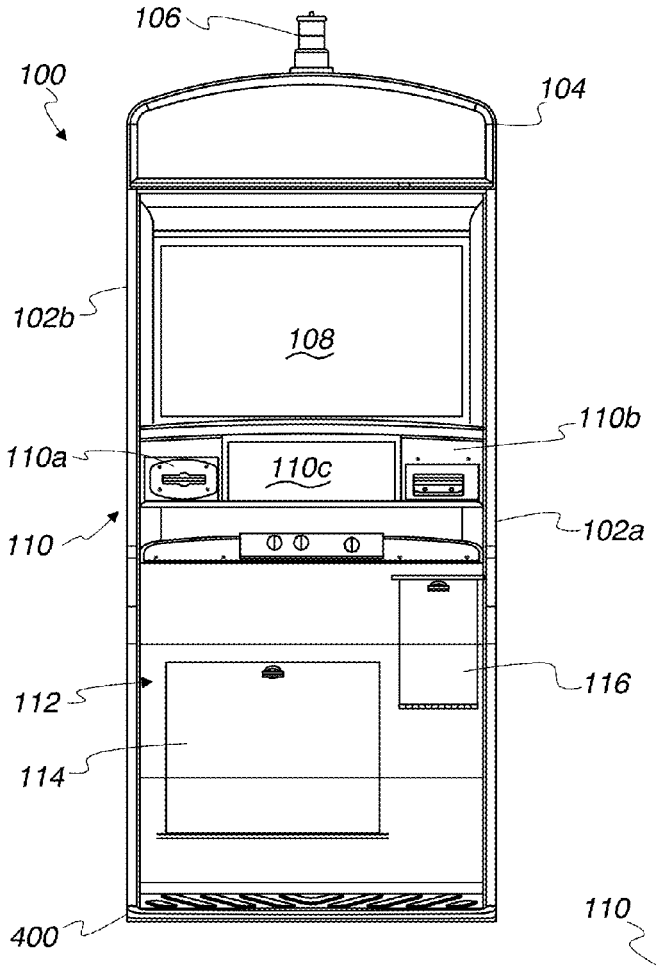
FIG. 1 illustrates a front view of a gaming cabinet constructed in accordance with the disclosure provided herein.

FIG. 1 illustrates a gaming unit 100 including a cabinet 102 configured to carry or include a top box 104. The top box 104 may include or support, for example, a video display configured to attract players and/or implement a secondary gaming opportunity. Alternatively, the top box 104 may include a translucent sign or other advertisement. The top box 104 may be utilized in connection with the game being implemented on the gaming unit 100 or may be in communication with one or more other top boxes or marquees (not shown) operable within the gambling casino. The top box 104 may further support or include a light tower 106. The light tower 106 may, like the top box 104, be utilized to attract players. The light tower 106 may further be utilized to provide a visual status indicator of the gaming unit 100. For example, if the tower light 106 displays a green light, the gaming unit 100 is operating normally. However, if the tower light 106 displays a yellow or a red light, the gaming unit 100 may require service or other attention. The light tower 106 may be programmed or configured to flash and/or alternate lights in order to indicate a win.

The gaming cabinet 102 may further carry a monitor or video display 108 disposed or positioned above a game play area generally indicated by the reference numeral 110. The game play area 110 may include a printer 110*a*, a value input or bill acceptor 110*b* and an information panel 110*c*. The value input 110*b* may be a card reader or a bill scanner configured to receive or input value. For example, a player may insert a gambling casino card (not shown) into the value input 110*b* to link player's debits or credits to a gambling casino bill. Alternatively, the player may insert a credit card into the value input 110*b* to charge an amount to be gambled at the gaming unit. The printer 110*a* may be utilized to provide a receipt of: charges against the player's bill or credit card; winnings accumulated at the gaming unit 100; and/or coupons or other incentives earned or provided while interacting with the gaming unit 100. The information panel 110*c* may be a player tracking device or component that includes, for example, an interactive miniature display screen, a scrolling light emitting diode (LED) display bar and/or a static display or graphic providing rules and/or information regarding the gaming unit 100.

The monitor or video display may be, for example, a wide screen liquid crystal display such as a super video graphics array (SVGA) or an ultra video graphics array (UVGA). Alternatively, the monitor or video display may be a cathode ray tube (CRT) display, a plasma display or any other type of projection or display technology.

The cabinet 102 may further include a base portion 112 having access panels 114 and 116. The base portion 112 may be a separate unit upon which the top box 104, the monitor or video display 108 and/or the game play area 110 may be supported. In this exemplary embodiment, the base portion 112 is a contiguous portion of the cabinet 102.

Figure 2:
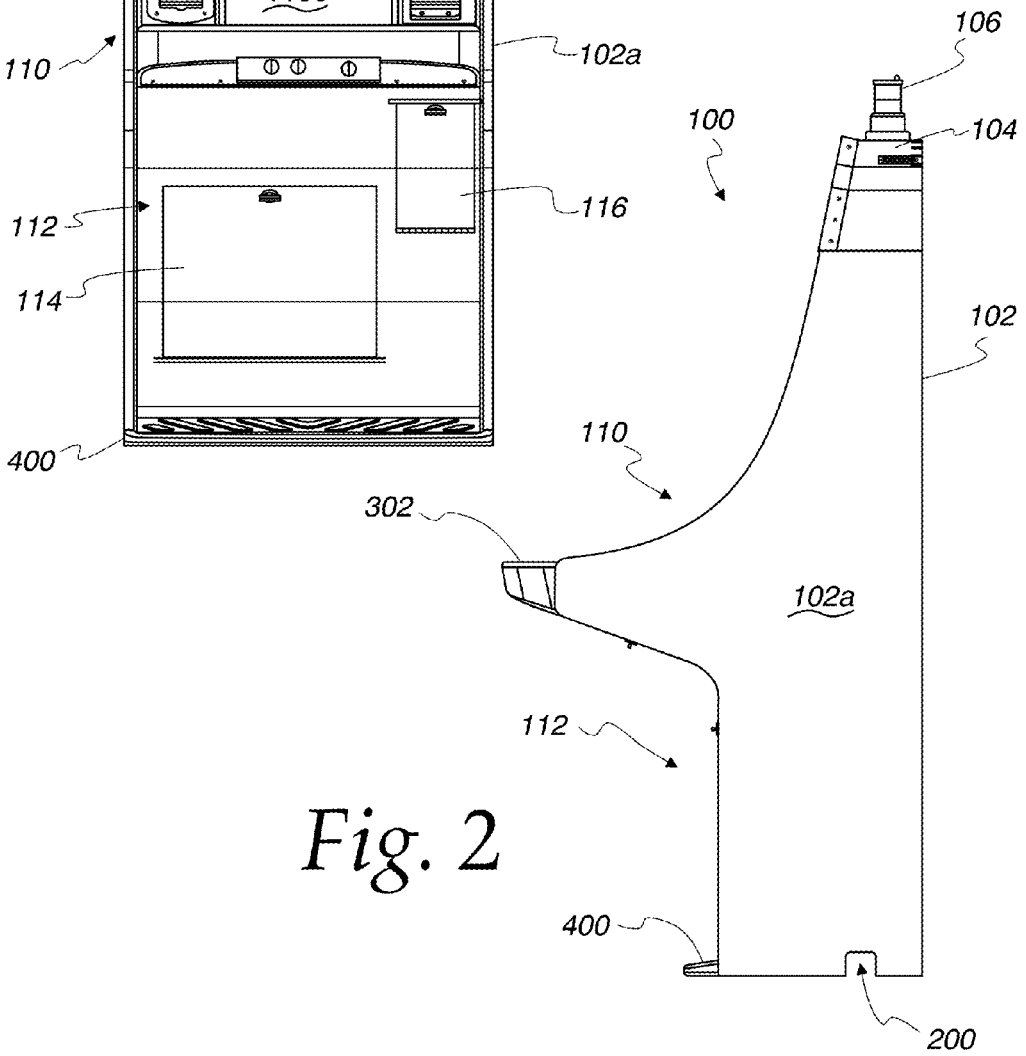
FIG. 2 illustrates a side view of the gaming cabinet shown in FIG. 1.

FIG. 2 generally illustrates a side view of the gaming unit 100. In particular, the side view illustrates a side panel 102*a* portion of the cabinet 102. It will be understood that the cabinet 102 may be configured for both seated and standing game play by adjusting, for example, the height of the base portion 112 and/or the angle or tilt of the monitor or video display 108. The side panel 102*a* may be a single panel as shown or may include, for example, multiple panel portions such as a top portion and a bottom portion. The side panel 102*a* may further include a cut out 200 sized and positioned to allow power and communication cables to be provided to the gaming unit 100. A second cut-out (not shown) may be provided in the side panel 102*b* (see FIG. 4) to allow power and communications cables to be daisy chained between multiple gaming units 100 positioned adjacent to each other.

Figure 3:
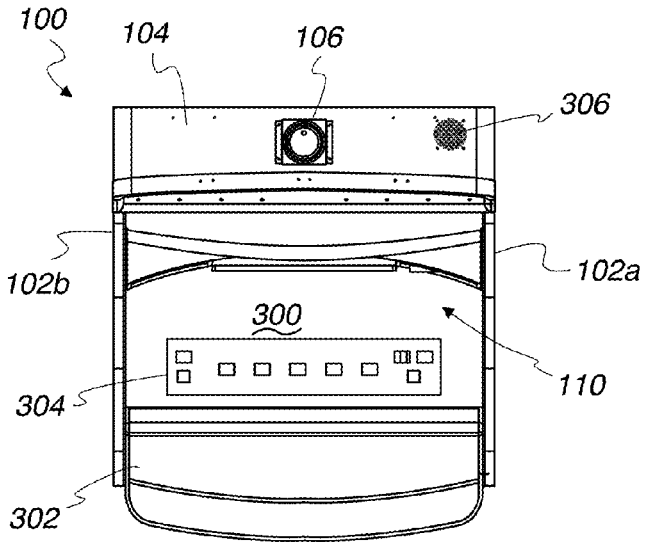
FIG. 3 illustrates a top view of the gaming cabinet shown in FIG. 1.

FIG. 3 illustrates a top view of the cabinet 102. The top view shows the light tower 106 centered and secured to a top surface of the top box 104. The top box 104 may further include a speaker and/or cooling vent 306. The top view further details a playing surface portion 300 of a gaming deck or playing surface 302. The gaming deck 302 may include user controls 304. The user controls 304 may be buttons, switches or other input keys. Alternatively, the user controls 304 may be presented via a reconfigurable touch panel display. For example, a capacitive touch screen may be flushly embedded in the playing surface 300. In operation, the player may be presented with different choices or configurations depending on the type of gaming being played, the particular portion of the game that is being played or any other factor that may make game play more enjoyable and/or exciting.

Figure 4:
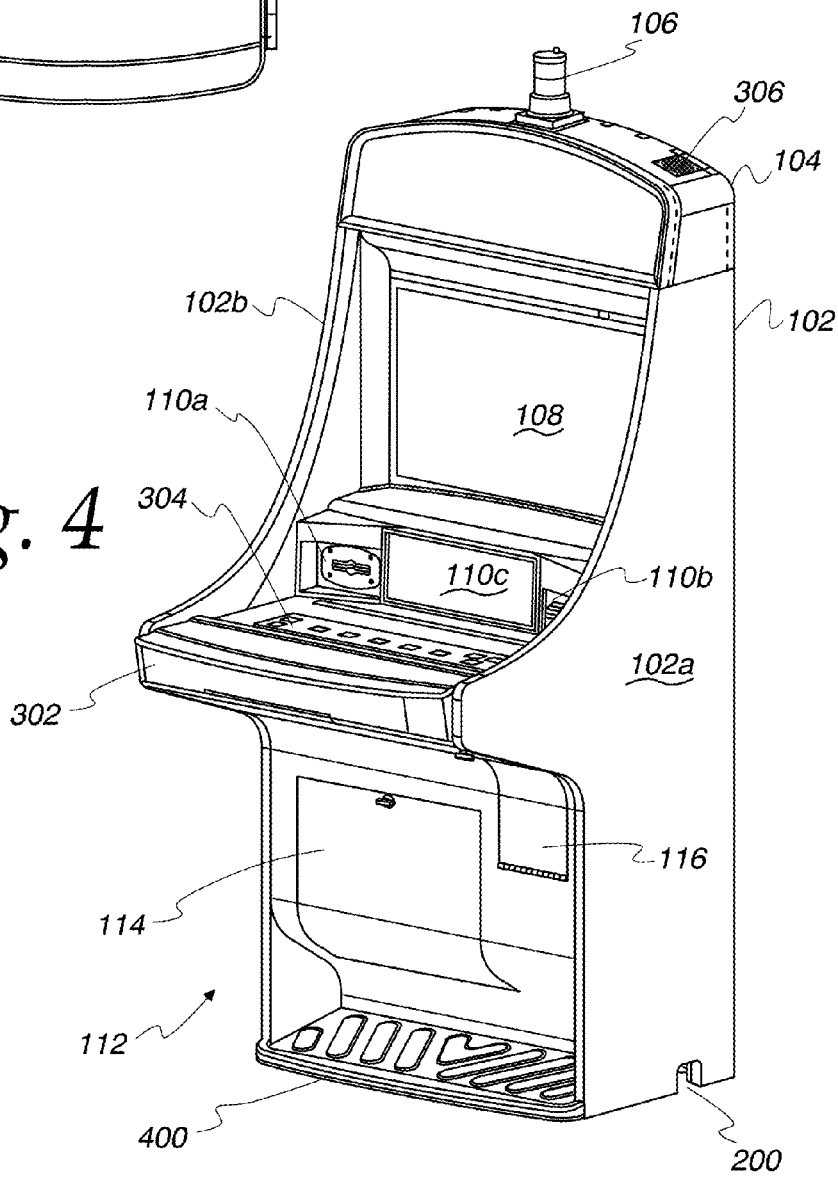
FIG. 4 illustrates an isometric view of the gaming cabinet shown in FIG. 1.
Figure 5:
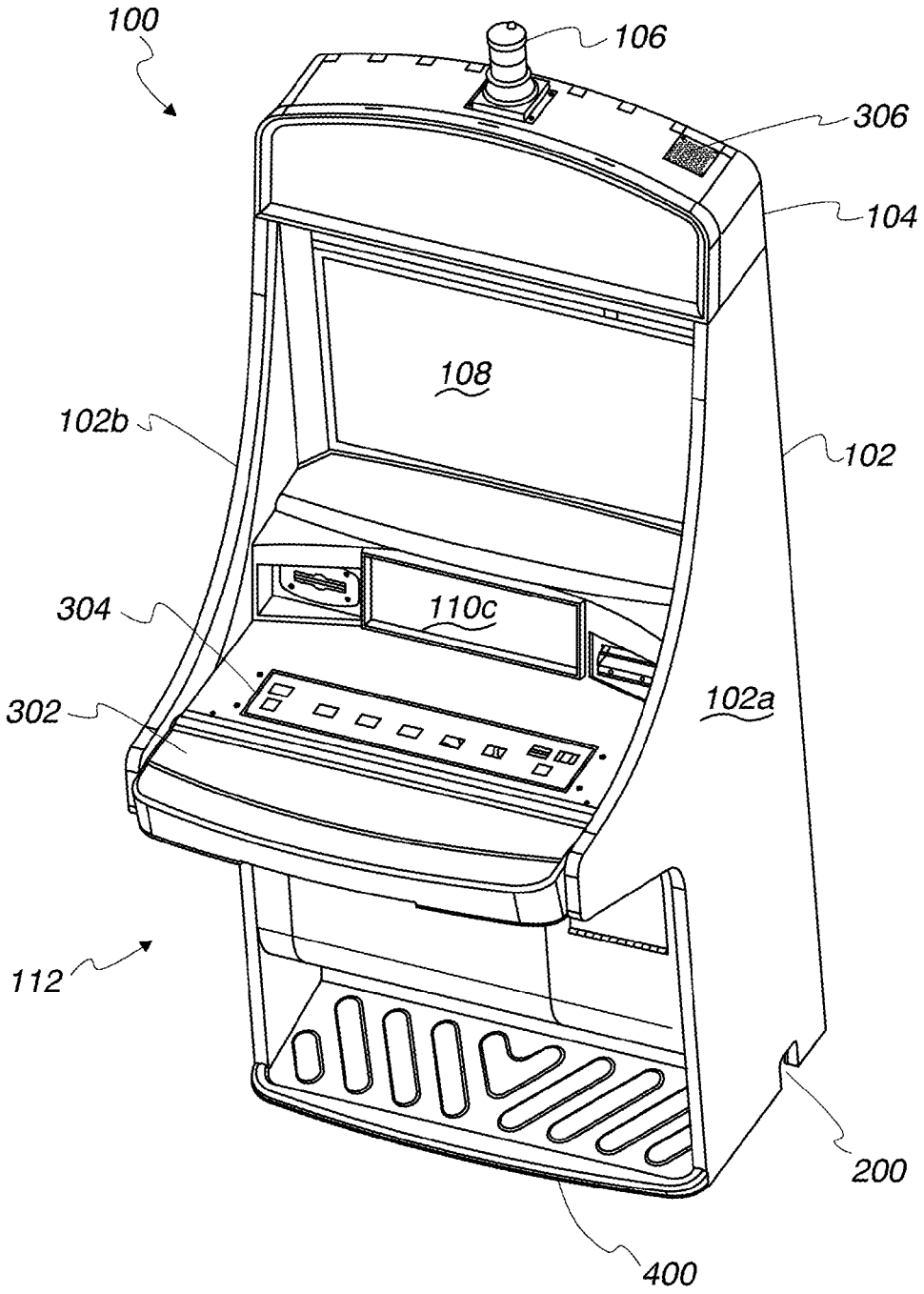
FIG. 5 illustrates an elevated isometric view of the gaming cabinet shown in FIG. 1.

FIGS. 4 and 5 illustrate isometric views of gaming unit 100 including the cabinet 102 and the associated top box 104 and light tower 106. The cabinet 102 includes side panels 102*a* and 102*b*. The gaming cabinet 102 may further carry the monitor or video display 108, which can be a flat panel display, in a substantially vertical arrangement. In alternate embodiments, the video display 108 may be inclined or angled. In yet other embodiments, the angle or incline of the video display 108 may be adjustable within a predefined range to increase player comfort. FIGS. 4 and 5 further illustrate that the base portion 112 includes access panels 114 and 116 and a footrest 400. The access panels 114 and 116 provide a direct means of accessing components within the base portion 112. For example, the access panel 114 may provide quick or easy access to the printer 110*a* and/or the paper supply for the printer 110*a*. The footrest 400 may be an adjustable footrest that can be angled and/or raised and lowered depending on the requirements and comfort of the player.

Figure 6:
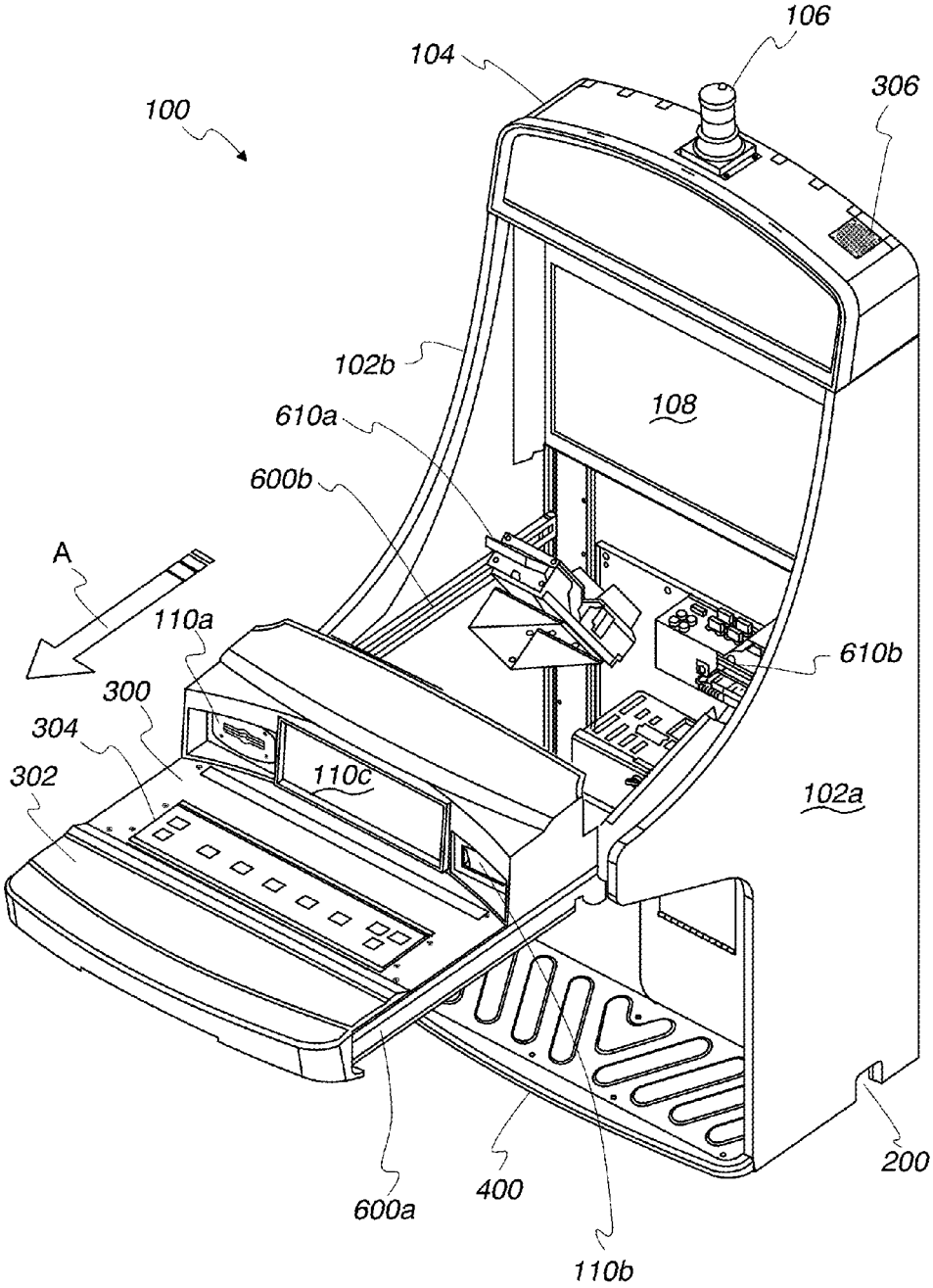
FIG. 6 illustrates the elevated isometric view of the gaming cabinet with a translatable playing surface or gaming deck.
Figure 7:
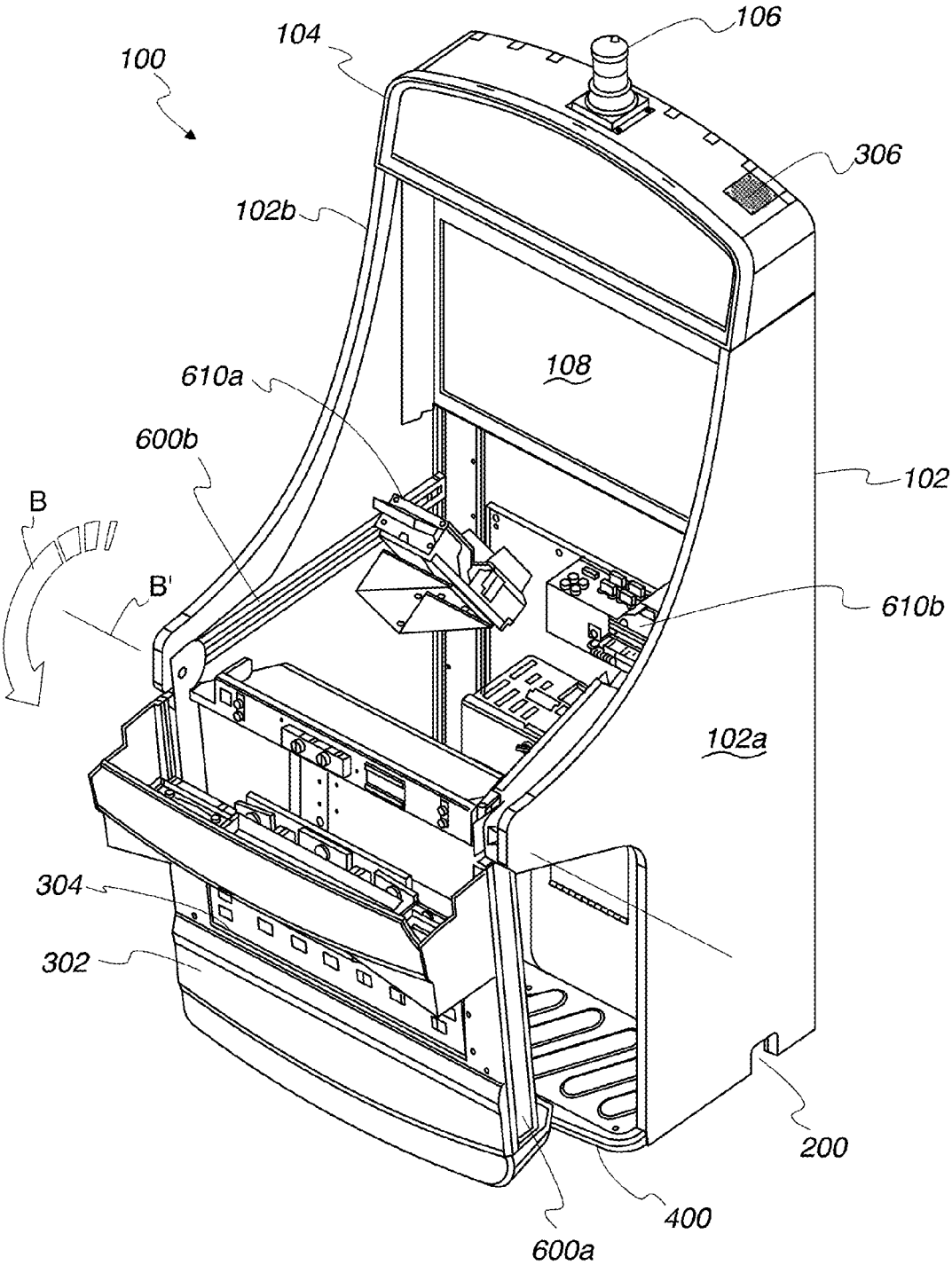
FIG. 7 illustrates the elevated isometric view of the gaming cabinet with the translatable playing surface in a downward rotated position.
Figure 8:
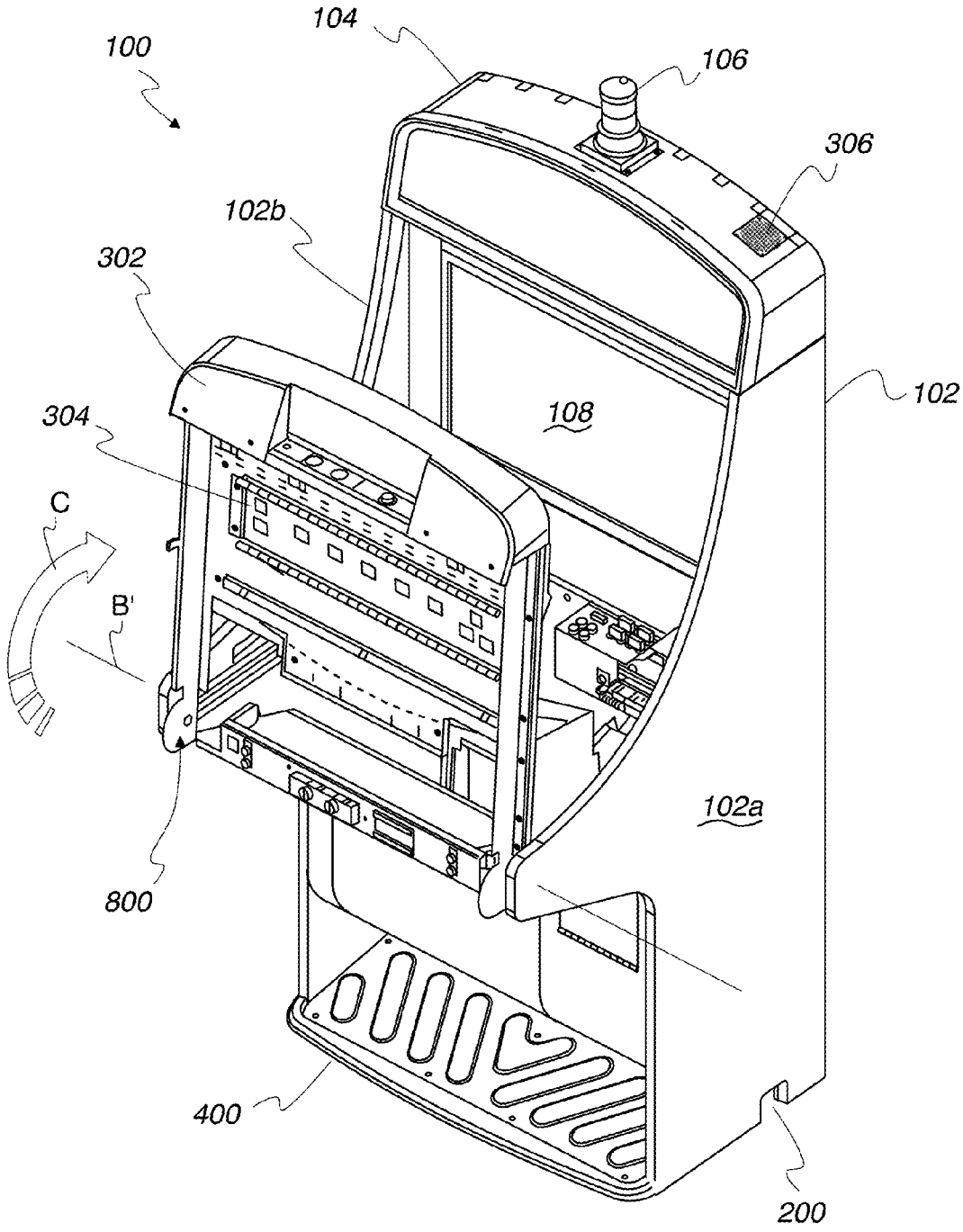
FIG. 8 illustrates the elevated isometric view of the gaming cabinet with the translatable playing surface in a upward rotated position.

FIGS. 6, 7 and 8 illustrate the cabinet 102 and translatable gaming deck 302 configured and positioned to allow access to an interior of the gaming unit 100. FIG. 6 illustrates the translatable gaming deck 302 carried by linear rails 600*a*, 600*b* mounted within side panels 102*a*, 102*b*, respectively. In one embodiment, the linear rails 600*a* and 600*b* may be custom manufactured telescoping rails. For example, the linear rails 600*a* and 600*b* may be manufactured to include or provide a fixed portion having a substantially "C" shaped cross-section adapted to be mounted horizontally to an inner surface of the side panels 102*a* and 102*b*. The linear rails 600*a* and 600*b* may further include a slidable or translatable portion carried within the "C" shaped cross-section of the fixed portion. The slidable or translatable portion of the exemplary linear rails 600*a* and 600*b* are, in turn, configured to mount to the gaming deck 302 thereby allowing the different rail portions (and the attached gaming deck 302) to slide horizontally relative to each other in a telescoping fashion (see FIG. 6, arrow A). The gaming deck 302 and the slidable or translatable portion of the exemplary linear rails 600*a* and 600*b* can linearly slide or translate as indicated by the arrow A (FIG. 6)

far enough to disengage from fixed portion of the linear rails 600*a* and 600*b*. In another embodiment, the travel of the gaming deck 302 may be limited utilizing, for example, one or more pins co-axially located (see, for example, the pivot or center of rotation collinear with the axis B' and the engaging lock 800) on the left and right side of the gaming deck 302 (see FIG. 8.) The exemplary pins may be arranged to prevent the gaming deck 302 from separating from cabinet 102 coming completely free from the cabinet when the gaming deck 302 is moved to its most forward position. The gaming deck 302 may, in turn, rotate about the pins in the directions indicated by the arrows B and/or C.

The linear rails 600*a*, 600*b* allow the entire game play area 110 to be translated linearly away from the video display 108 in the direction indicated by arrow A to allow access to an interior of the cabinet 102. For example, when the interior of the gaming unit 100 requires maintenance or adjustment, maintenance personal may grasp and pull the entire game play area 110 away from the cabinet 102. The game play area 102, in turn, slides or translates along the linear rails 600*a* and 600*b* to a position substantially parallel to the floor upon which the base portion 112 is supported.

FIG. 7 illustrates that once the translatable gaming deck 302 carried by the linear rails 600*a*, 600*b* is in an extended position as shown in FIG. 6, the translatable gaming deck 302 may be rotated about an axis B' in the direction indicated by the arrow B to a downward position. In this downward position, the translatable gaming deck 302 is substantially perpendicular to the floor upon which the base portion 112 is supported. When the translatable gaming deck 302 is in the downward position, the interior of the cabinet 102 may be easily accessed by maintenance personal. For example, the hardware 610*a* and 610*b* for the printer 110*a* and the value input 110*b*, respectively, may be repaired or replaced without having to remove panels or portions of the gaming unit 100 which can create hazard and/or traffic flow problem within the gambling casino. Thus, by making maintenance simpler to conduct, the gaming unit 100 can be kept operational for longer periods of time thereby increasing the gambling casinos revenues.

FIG. 8 illustrates the translatable gaming deck 302 carried by the linear rails 600*a*, 600*b* and rotated about an axis B' in the direction indicated by the arrow C to an upward position. Thus, rather than allowing gravity to pull the gaming deck 302 downward to a position substantially adjacent to the base portion 112, a maintenance person may lift the gaming deck 302 to a position substantially parallel to the video display 108. The gaming unit 100 may further include or cooperate with an automatically engaging lock mechanism 800 positioned to secure the translatable gaming deck 302 in the upward position. The engaging lock 800 may prevent the translatable gaming deck 302 from accidentally moving and injuring a maintenance person when they are working on the base portion 112. The engaging lock 800 or safety latch may, in one exemplary embodiment, include a spring-loaded stopper (not shown) held in a compressed position by an interference with the gaming deck 302 until the gaming deck 302 moves into the full forward position and then rotates into the upward position. The spring-loaded stopper then extends to an uncompressed position to prevent the gaming deck 302 from rotating in an uncontrolled manner between the vertical position (see FIG. 7, arrow B). The spring-loaded stopper may be manually moved to the compressed position allowing the gaming deck 302 to rotate back to the horizontal position. Furthermore, when the translatable gaming deck 302 is in the upward position, underside of the user controls 304 may be accessible.

Figure 9:
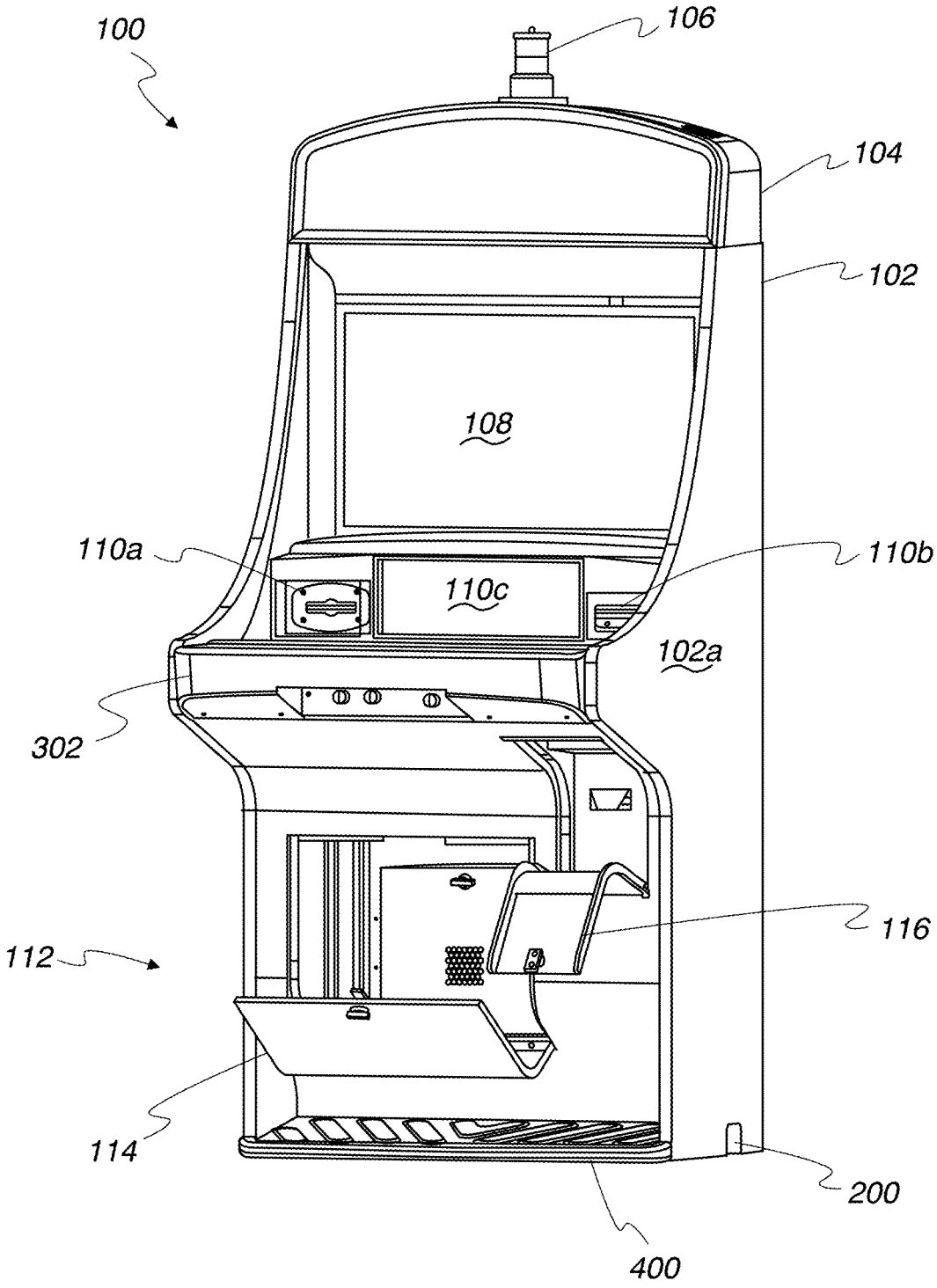
FIG. 9 illustrates the isometric view of the gaming cabinet showing additional access panels.

FIG. 9 illustrates a perspective view of the gaming unit 100 with the access panels 114 and 116 open to allow further access to the interior of the cabinet 102 via the base portion 112.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A gaming cabinet comprising:

a first side panel;

a second side panel disposed away from and parallel to the first side panel;

a video display carried between the first and second side panels, wherein the video display is arranged perpendicular to the first and second side panels;

a translatable gaming deck carried between the first and second side panels, wherein the translatable gaming deck is arranged perpendicular to the first and second side panels and the video display, wherein the translatable gaming deck is configured to be linearly translated away from the video display, and wherein the translatable gaming deck is configured to be rotated to a position parallel to the video display when linearly translated away from the video display, wherein the translatable gaming deck is rotatable between a first vertical position and a second vertical position, and wherein the second vertical position is a downward position parallel to the video display and adjacent to a base portion.

2. The gaming cabinet of claim 1, wherein the first vertical position is an upward position substantially parallel to the video display.

3. The gaming cabinet of claim 1 further comprising at least one linear rail configured to guide the translatable gaming deck.

4. The gaming cabinet of claim 3, wherein the at least one linear rail includes a lock mechanism configured to secure the translatable gaming deck.

5. The gaming cabinet of claim 4, wherein the lock mechanism is an automatically engaging locking mechanism.

6. A gaming unit comprising:

a gaming cabinet including a first side panel disposed away from and substantially parallel to a second side panel;

a video display carried by the gaming cabinet, wherein the video display is arranged perpendicular to the first and second side panels;

a gaming deck translatable along at least one linear rail mounted to an interior surface of the first and second side panels, wherein the gaming deck is aligned perpendicular to the first and second side panels and the video display, wherein the translatable gaming deck is configured to be linearly translated away from the video display along the at least one linear rail, wherein the translatable gaming deck is rotatable between a first vertical position and a second vertical position, and wherein the second vertical position is a downward position parallel to the video display and adjacent to a base portion.

7. The gaming cabinet of claim 6, wherein the first vertical position is an upward position parallel and adjacent to the video display.

8. The gaming cabinet of claim 6, wherein the at least one linear rail includes a lock mechanism configured to secure the gaming deck.

9. The gaming cabinet of claim 8, wherein the lock mechanism is an automatically engaging locking mechanism.

10. The gaming cabinet of claim 6, wherein the translatable gaming deck is configured to rotate to a vertical position parallel to the video display when linearly translated away from the video display.

11. A method of servicing a gaming unit including a gaming cabinet having a first side panel disposed away from and parallel to a second side panel and a video display carried by the gaming cabinet, wherein the video display is arranged perpendicular to the first and second side panels, the method comprising:

engaging a gaming deck portion of the gaming unit wherein the gaming deck is aligned perpendicular to the first and second side panels and the video display;

translating the gaming deck portion of the gaming unit along at least one linear rail mounted to an interior surface of the first and second side panels wherein the translatable gaming deck is configured to be linearly translated away from the video display along the at least one linear rail; and rotating the translated gaming deck between a first vertical position and a second vertical position, wherein the second vertical position is a downward position parallel to the video display and adjacent to a base portion.

12. The method of claim 11, wherein the first vertical position is an upward position parallel and adjacent to the video display.

13. The method of claim 11, wherein the at least one linear rail includes a lock mechanism configured to secure the gaming deck.

14. The method of claim 13, wherein the lock mechanism is an automatically engaging locking mechanism.

* * * * *